US012232544B1

(12) United States Patent
Tecu et al.

(10) Patent No.: US 12,232,544 B1
(45) Date of Patent: Feb. 25, 2025

(54) SOCK AND GAITER COMBINATION

(71) Applicant: Bond Consulting Services, Inc., Mead, CO (US)

(72) Inventors: Kirk Steven Tecu, Longmont, CO (US); Duncan Doyle, Denver, CO (US); Sean Michael Shiers, Mead, CO (US)

(73) Assignee: Bond Consulting Services, Inc., Longmont, CO (US)

( * ) Notice: Subject to any disclaimer, the term of this patent is extended or adjusted under 35 U.S.C. 154(b) by 0 days.

(21) Appl. No.: 17/937,452

(22) Filed: Oct. 2, 2022

Related U.S. Application Data

(60) Provisional application No. 63/262,504, filed on Oct. 14, 2021.

(51) Int. Cl.
*A41B 11/12* (2006.01)
*A41D 17/00* (2006.01)

(52) U.S. Cl.
CPC ..... *A41B 11/125* (2013.01); *A41D 17/00* (2013.01)

(58) Field of Classification Search
CPC ..... A41D 17/00
See application file for complete search history.

(56) References Cited

U.S. PATENT DOCUMENTS 2,571,543 A * 10/1951 Connor ..... A41B 11/00 112/427
4,961,235 A * 10/1990 Williger ..... A41B 11/006 2/919
5,157,791 A * 10/1992 Woodson ..... D04B 1/26 2/247
5,664,263 A * 9/1997 Reynolds ..... A41B 11/006 2/247
5,682,616 A * 11/1997 Pisano ..... A41B 11/00 2/22
6,381,756 B1 * 5/2002 Smith ..... A41B 11/00 2/242
2002/0029405 A1 * 3/2002 Outwater ..... A41B 11/006 2/239

* cited by examiner

*Primary Examiner* — Jocelyn Bravo
(74) *Attorney, Agent, or Firm* — Trenner Law Firm, LLC; Mark Trenner

(57) ABSTRACT

A sock and gaiter combination is disclosed as an article of clothing. An example of the sock and gaiter combination includes a sock having a calf portion, an ankle portion and a foot portion. The example sock and gaiter combination also includes a gaiter integral with the sock. The gaiter is operable between a sock configuration and a gaiter configuration. The gaiter covers the calf portion of the sock in the sock configuration. The gaiter is folded down at least partially over the ankle portion of the sock in the gaiter configuration. In an example, the sock and gaiter combination includes a transition area between the ankle portion and the calf portion of the sock.

8 Claims, 5 Drawing Sheets

SOCK AND GAITER COMBINATION

This application claims the priority filing benefit of U.S. Provisional Patent Application No. 63/262,504 filed Oct. 14, 2021 for "Sock and Gaiter Combination" of Tecu, et al., hereby incorporated by reference in its entirety as though fully set forth herein.

BACKGROUND

Wearing socks with shoes or boots in an outdoor environment inevitably leads to debris getting into shoes or boots. The debris (e.g., pebbles, dirt, grass, etc.) works its way in between the space around the top of the shoe opening.

Gaiters have been used to help reduce debris from entering into shoes or boots. A gaiter is a sleeve that can be worn separate from the boot and sock and can be pulled over the opening between the boot or shoe and the sock. Though it can be very effective in reducing debris in the boot, it is an additional article of clothing that also requires additional adjustment when a user puts their socks and boots on.

DETAILED DESCRIPTION

A sock and gaiter combination is disclosed as an article of clothing. An example sock and gaiter combination includes a sock having a calf portion, an ankle portion and a foot portion. The example sock and gaiter combination also includes a gaiter integral with the sock. The gaiter is operable between a sock configuration and a gaiter configuration. In the sock configuration, the gaiter covers the calf portion of the sock. In the gaiter configuration, the gaiter is folded down at least partially (and may be fully folded) over the ankle portion of the sock. In an example, the sock and gaiter combination includes a transition area between the ankle portion and the calf portion of the sock.

An example sock and gaiter combination is an article that can be worn over a user's foot like a sock, but can be easily converted to perform the function of a gaiter when desired. The gaiter portion of the article is integral to the sock portion, but otherwise the article looks and acts like a sock until it is configured as a gaiter. In an example, when the gaiter is worn in the sock configuration above the transition area, the overall clothing article has a consistent thickness, and thus feel for the user, throughout the foot, the ankle, and the calf of the sock.

The example sock and gaiter combination enables the user to have a single article of clothing that can be worn as a sock. In addition, the sock and gaiter combination provides an "on-demand" gaiter for the wearer, for example, so that the clothing article is effective in reducing debris from entering the space between the sock and the shoe, boot, or other footwear the user is wearing. The user does not have to decide whether to affix a separate, additional gaiter to their clothing at the time they put their socks and footwear on.

Before continuing, it is noted that as used herein, the terms "includes" and "including" mean, but is not limited to, "includes" or "including" and "includes at least" or "including at least." The term "based on" means "based on" and "based at least in part on."

It is also noted that the examples described herein are provided for purposes of illustration, and are not intended to be limiting. Other devices and/or device configurations may be utilized to carry out the operations described herein.

The operations shown and described herein are provided to illustrate example implementations. It is noted that the operations are not limited to the ordering shown. Still other operations may also be implemented.

Figure 1:
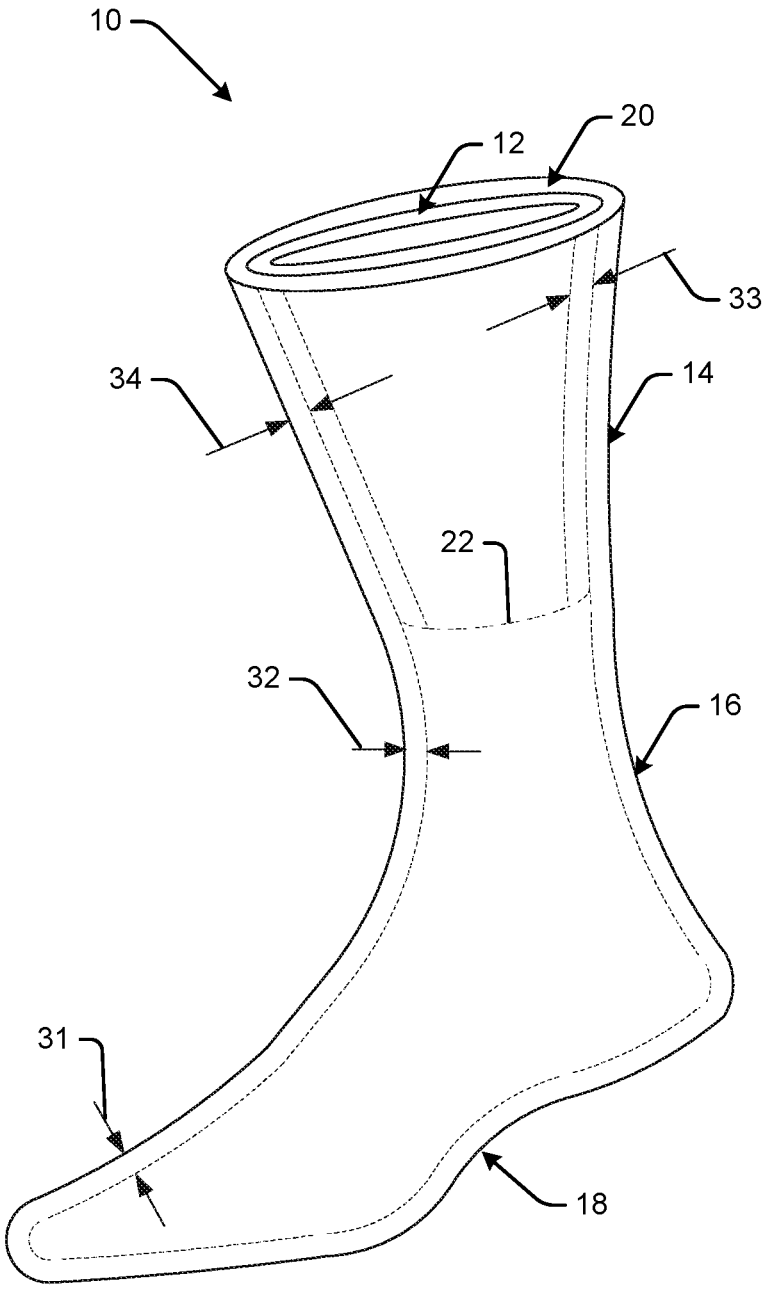
FIG. 1 shows an example sock and gaiter combination in a sock configuration.
Figure 2:
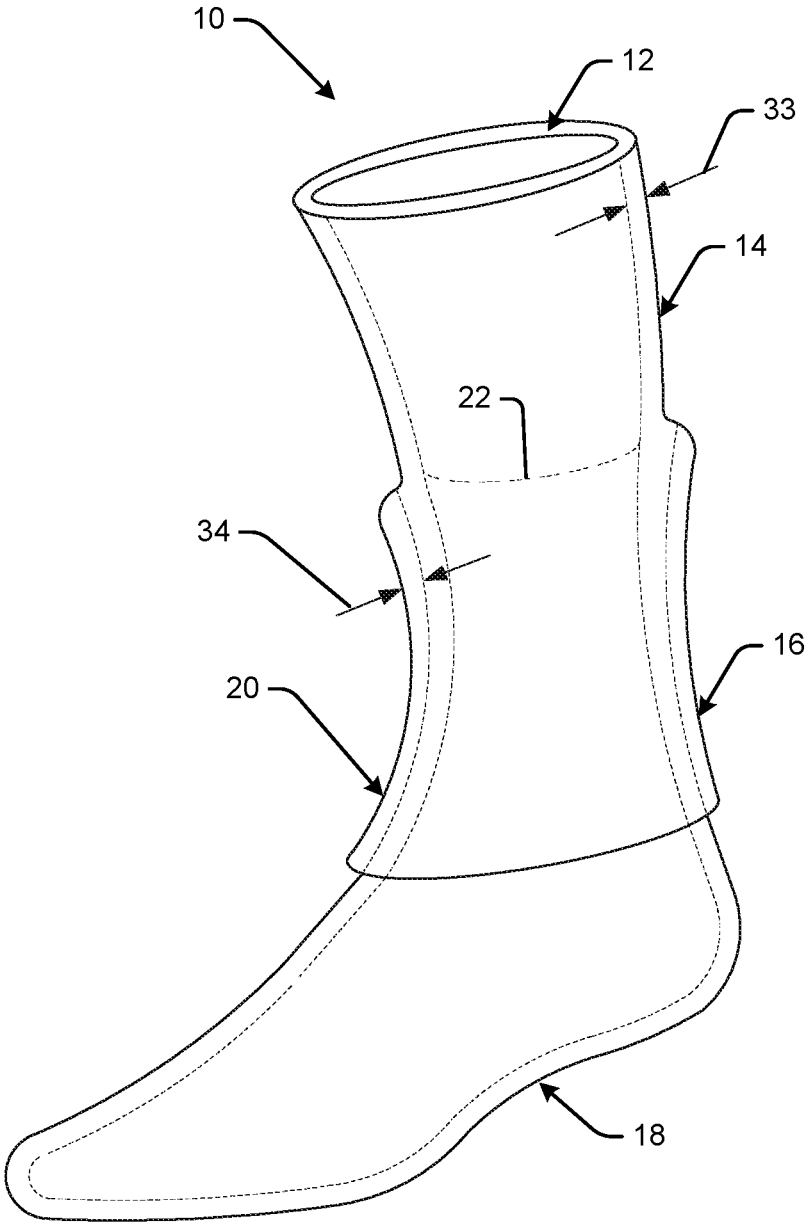
FIG. 2 shows an example sock and gaiter combination in a gaiter configuration.

An example sock and gaiter combination is described herein as an article of clothing 10. FIG. 1 shows an example sock and gaiter combination 10 in a sock configuration. FIG. 2 shows an example sock and gaiter combination in a gaiter configuration. The example sock and gaiter combination 10 includes a sock 12. The sock has a calf portion 14, an ankle portion 16, and a foot portion 18. The example sock and gaiter combination 10 also includes a gaiter 20.

In an example sock configuration (FIG. 1), both the gaiter 20 and the sock 12 overlap one another. That is, the gaiter 20 is pulled up over the calf portion 14 of the sock 12. In an example gaiter configuration (FIG. 2), the calf portion 14 of the sock remains in the pulled up position (as it was in FIG. 1), and the gaiter 20 is pulled down and rolled the ankle portion 16 of the sock 12.

In an example, there is a transition area 22 between the sock 12 and the gaiter 20. The transition area 22 defines or delineates a portion of the example sock and gaiter combination 10 where the lower portion of the sock 12 terminates and the combination of both sock 12 and gaiter 20 are provided together on the example sock and gaiter combination 10. For example, the transition area 22 may be between the ankle portion and the calf portion of the sock. It is noted, however, that the transition area 22 is not limited to any specific location. For example, the transition area 22 may be lower down on the ankle portion 16 closer to or even in transition to the foot portion 18. In another example, the transition area 22 may be higher up on the calf portion 14.

The gaiter 20 is movable to provide the sock configuration (FIG. 1) and the gaiter configuration (FIG. 2). In the sock configuration, the gaiter 20 is overlaid on and at least partially (or fully) covers the calf portion 14 of the sock 12. In the gaiter configuration (FIG. 2), the gaiter is folded down at least partially (or fully) over the ankle portion 16 of the sock.

Figure 3:
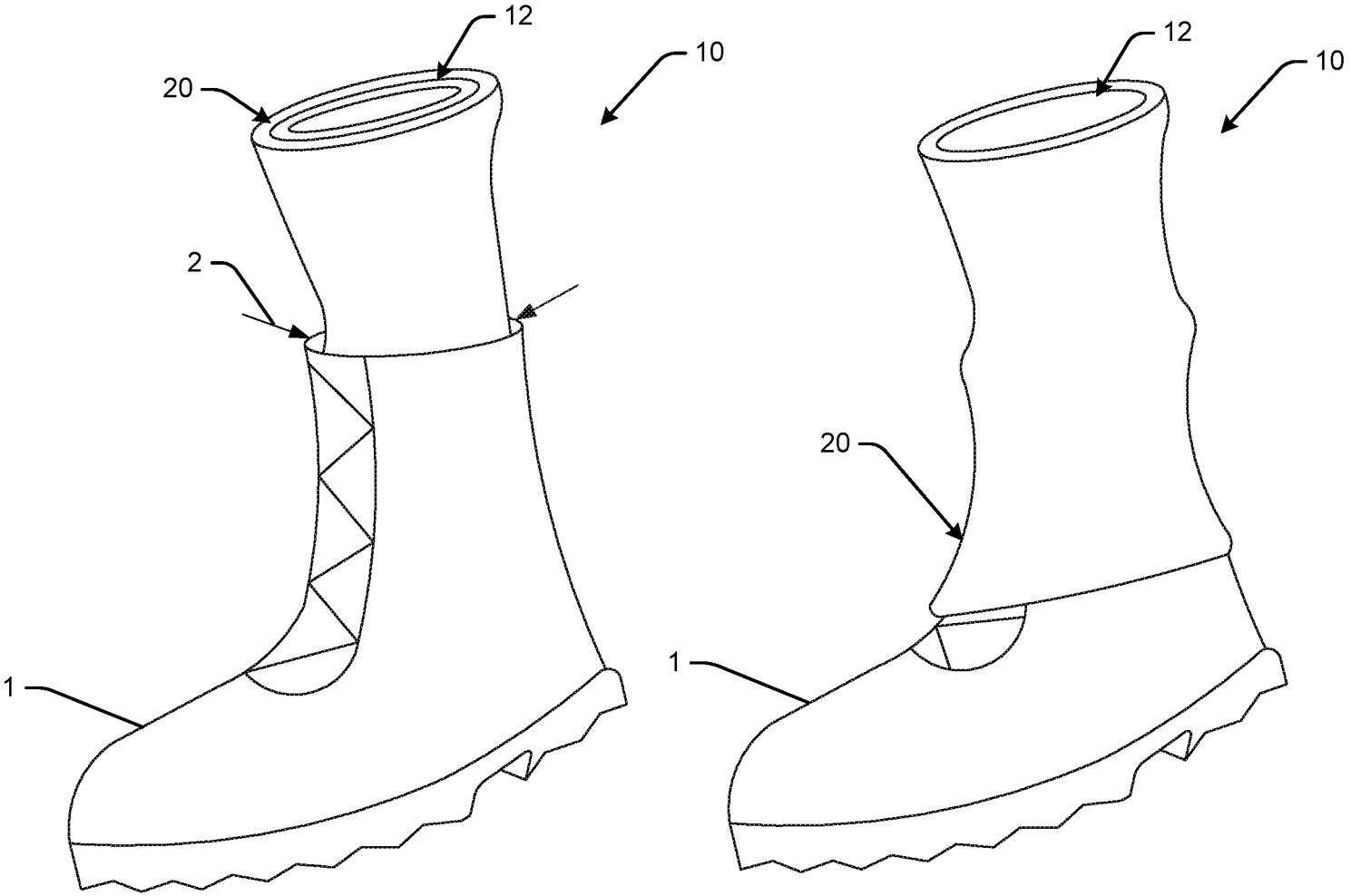
FIG. 3 shows the example sock and gaiter combination in both the sock configuration and the gaiter configuration, and the clothing article may be worn with a shoe, boot, or other footwear.

FIG. 3 shows the example sock and gaiter combination 10 in both the sock configuration (left) and the gaiter configuration (right), as the clothing article may be worn with a shoe, boot, or other footwear 1. When worn in the sock configuration, debris may enter into the space(s) 2 between the sock and the top opening of the boot 1. When in the gaiter configuration, debris may be reduced or altogether prevented from entering the opening at the top of the boot 1.

In an example, the sock 12 and the gaiter 20 are made of the same type of material. In another example, the sock 12 and the gaiter 20 are made of different types of material. For example, the gaiter 20 may be moisture resistant or even entirely waterproof to aid in the function of a gaiter, while the sock 12 may be made of more conventional sock material for comfort of the wearer.

It is noted that the term "material" as used herein may refer to any suitable type of material(s). In addition, the material may vary in different portions of the article of clothing 10. For example, a waterproof material may be provided for the gaiter 20 and perhaps even a portion of the sock 12 above the transition 22, while a more traditional sock material may also be provided for the sock 12 below the transition area 22.

It is noted that any suitable type and thickness of material may be implemented for the gaiter 20, the sock 12, and the transition area 22. For example, a thicker and/or waterproof or water-resistant material may be provided for the gaiter 20, while the sock 12 may be a more traditional sock material type and thickness. In an example, the sock 12 and gaiter 20 material thickness above the transition location 22 may each be half the thickness of the sock 12 material provided below the transition location 22. This results in a total material thickness being consistent throughout the full length of the clothing article 10 when worn in the sock configuration to enhance comfort and style for the user.

For purposes of illustration, the foot portion 18 of the sock 12 may be said to have a first thickness 31, the ankle portion of the sock has a second thickness 32, the calf portion of the sock 12 has a third thickness 33, and the gaiter 20 has a fourth thickness 34. It is noted that the terms first thickness, second thickness, third thickness, and fourth thickness are defined herein to refer to the material thickness of portions of the clothing article 10. It is noted that the terms first, second, third, and fourth have no significance other than to distinguish one thickness from another.

In an example, the first thickness 31 is the same as the second thickness 32.

In an example, the third thickness 33 is the same as the fourth thickness 34.

In an example, the combination of the third thickness 33 and the fourth thickness 34 is different from the second thickness 32.

In an example, the third thickness 33 is different from the fourth thickness 34.

In an example, the combination of the third thickness 33 and the fourth thickness 34 is substantially the same thickness as the second thickness 32. For example, the third thickness 33 and the fourth thickness 34 may be substantially the same as one another. For example, the third thickness 33 and the fourth thickness 34 may each be about one-half the second thickness 32. In another example, however, the same effect may be achieved by providing a thinner sock above the transition 22 than below the transition 22, while enabling a thicker gaiter 20, or vice versa (e.g., a thicker sock 12 and thinner gaiter 20).

In any of these examples, when the gaiter 20 is worn in the sock configuration above the transition area 22, the overall article 10 may have a consistent thickness throughout the foot 18, the ankle 16, and the calf 14 areas.

Figure 4:
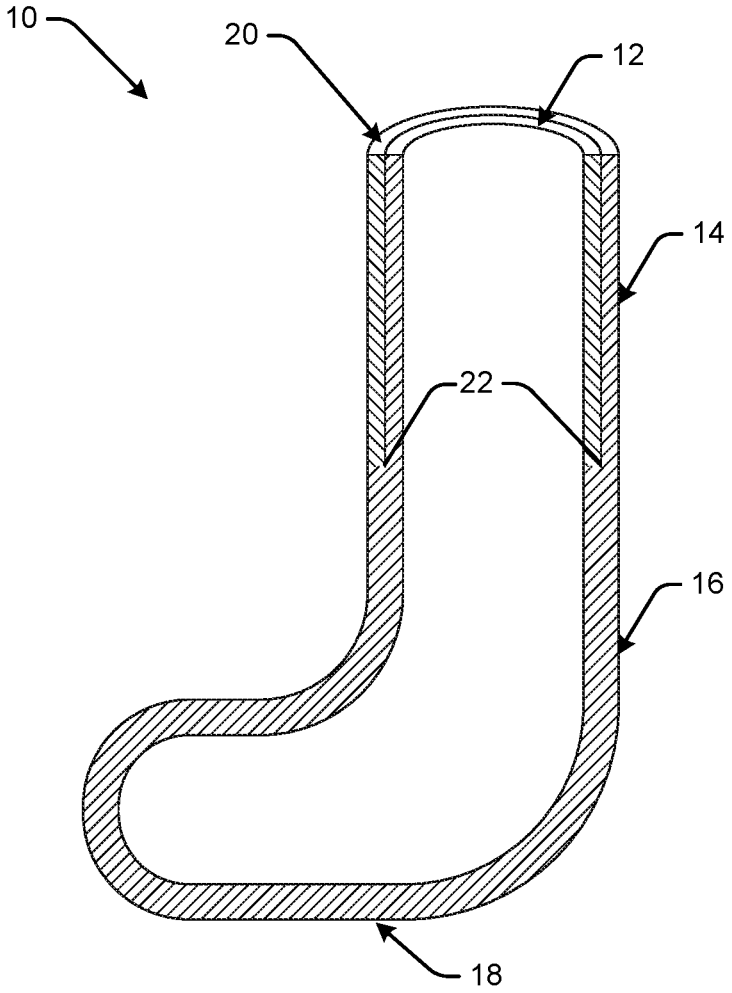
FIG. 4 is a cross sectional view of an example sock and gaiter combination.

FIG. 4 is a cross sectional view of an example sock and gaiter combination 10. In an example, the sock and gaiter combination 10 may be manufactured as separate portions that are connected (e.g., sewn) together. That is, the sock 12 and the gaiter 20 may be manufactured as distinct entities and combined with separate attachment (e.g., stitching) to each other.

In another example, it may be preferred (e.g., from a style and/or cleanliness point of view) that the sock 12 and gaiter 20 be manufactured together as a single article, without having to separately attach or sew these portions together. The sock 12 and the gaiter 20 may thus be manufactured as a single integrated unit without separate attachment (e.g., stitching). In this example, the sock 12 and the gaiter 20 have no separate attachment(s) to one another and are instead unitary in structure (e.g., made of the same piece of material).

Figure 5:
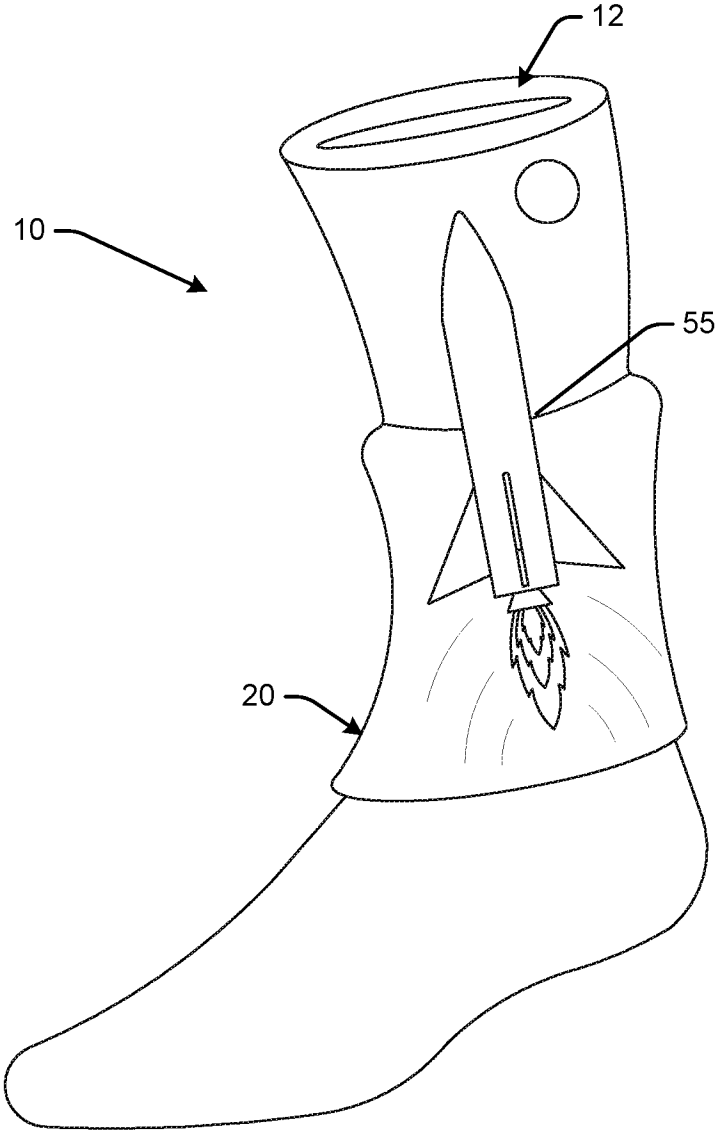
FIG. 5 shows another example sock and gaiter combination in both the sock configuration and the gaiter configuration to illustrate a changing design pattern.
Figure 5:
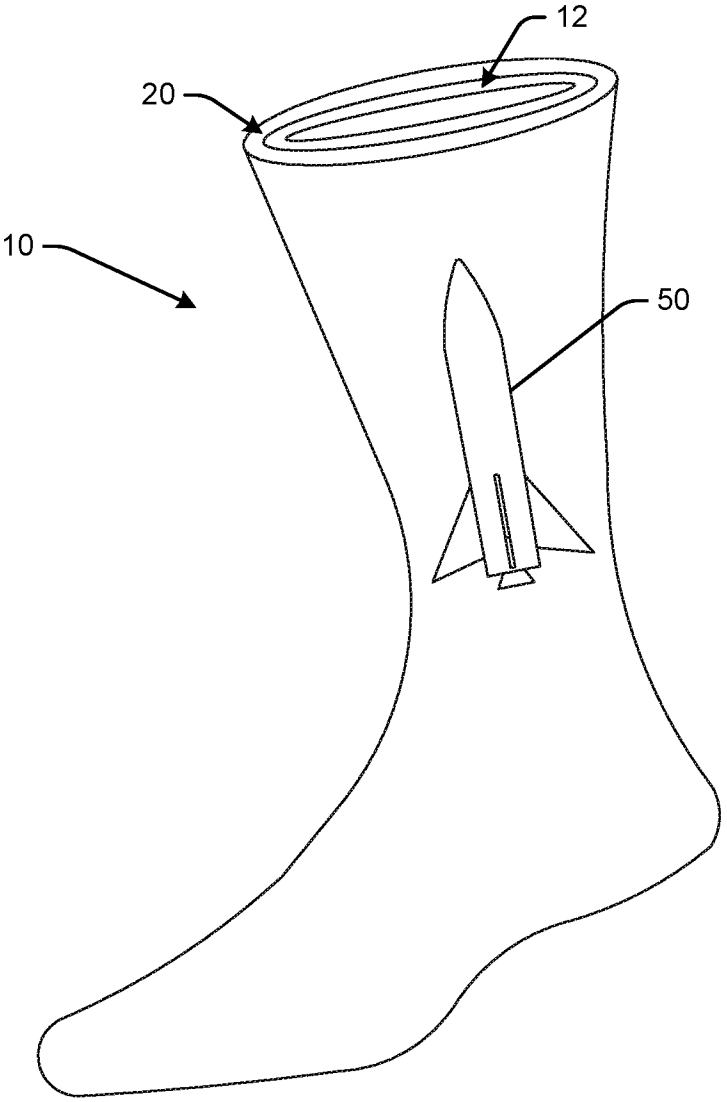

FIG. 5 shows another example sock and gaiter combination 10 in both the sock configuration (left) and the gaiter configuration (right) to illustrate a changing design pattern 50, 55. In an example, the design pattern 50, 55 may be provided by an object or component of the sock and/or gaiter material itself (e.g., beads). In another example, the design pattern 50, 55 may be provided on the sock and/or gaiter material (e.g., by fabric paint). In either example, two different design patterns 50, 55 are visible. A first design pattern 50 is visible (left) when the sock and gaiter combination 10 is worn in the sock configuration. The design pattern can be changed, and a second design pattern 55 is visible (right) when the sock and gaiter combination 10 is worn in the gaiter configuration.

It is noted that the examples shown and described are provided for purposes of illustration and are not intended to be limiting. Still other examples are also contemplated.

The invention claimed is:

1. A sock and gaiter combination article of clothing, comprising:

a sock formed of a single layer and having a calf portion, an ankle portion and a foot portion; and a gaiter coupled to the sock, the gaiter operable between a sock configuration and a gaiter configuration, the gaiter covering the calf portion of the sock in the sock configuration, and the gaiter folded down at least partially over the ankle portion of the sock in the gaiter configuration; and a transition area between the calf portion of the sock and the ankle portion of the sock;

wherein the foot portion of the sock has a first thickness, the ankle portion of the sock has a second thickness, the calf portion of the sock has a third thickness, and the gaiter has a fourth thickness;

wherein the single layer of the sock has a smaller thickness above the transition area and a greater thickness below the transition area, such that the combination of the third thickness and the fourth thickness is substantially the same thickness as the second thickness, and such that, when the gaiter is in the sock configuration, the overall article has a consistent thickness throughout the foot, ankle, and calf portions.

2. The sock and gaiter combination of claim 1, wherein the sock and the gaiter are made of the same type of material.

3. The sock and gaiter combination of claim 1, wherein the sock and the gaiter are made of different types of material.

4. The sock and gaiter combination of claim 3, wherein the gaiter is moisture resistant.

5. The sock and gaiter combination of claim 3, wherein the gaiter is waterproof.

6. The sock and gaiter combination of claim 1, wherein the sock and the gaiter are manufactured as distinct entities and combined with separate attachment to each other.

7. The sock and gaiter combination of claim 1, wherein the sock and the gaiter are manufactured as a single integrated unit.

8. The sock and gaiter combination of claim 7, wherein the sock and the gaiter have no separate attachment to one another.

* * * * *